United States Patent [19]

Hosmer

[11] Patent Number: 5,003,764

[45] Date of Patent: Apr. 2, 1991

[54] NOZZLE TEXTURIZER FOR YARN MANUFACTURING

[75] Inventor: Jimmy D. Hosmer, Scottsboro, Ala.

[73] Assignee: Hosmer Machinery & Engineering, Inc., Scottsboro, Ala.

[21] Appl. No.: 421,250

[22] Filed: Oct. 13, 1989

[51] Int. Cl.[5] ..... D01H 7/92

[52] U.S. Cl. ..... 57/333

[58] Field of Search ..... 57/333, 328, 350, 289; 28/271-276

[56] References Cited

U.S. PATENT DOCUMENTS

| | | | |
|---|---|---|---|
| 3,910,021 | 10/1975 | VanPetten | 57/333 X |
| 3,958,310 | 5/1976 | Blanc et al. | 57/333 X |
| 4,408,446 | 10/1983 | Wilkie | 57/289 X |

*Primary Examiner*—Joseph J. Hail, III

*Attorney, Agent, or Firm*—Phillips & Beumer

[57] ABSTRACT

An improved nozzle texturizer providing for twisting as well as kinking of extruded synthetic fiber material strands is disclosed. Apertures for introduction of heated compressed air into a longitudinally extending bore of the texturizer body at a location below the upper region of the bore are offset longitudinally with respect to one another to create a swirling action upon introduction of compressed air, causing the strands to become twisted, in addition to being kinked in a downstream nozzle region. Passageways into the apertures are disposed at angles of 43° to 45° with respect to the bore, much steeper than in prior devices, to further contribute to the swirling action. The body is made up of a pair of mating blocks with the bore and other apertures defined therein. In order to prevent warpage in use, the texturizer may be made of heat-treated, hardened steel.

4 Claims, 3 Drawing Sheets

NOZZLE TEXTURIZER FOR YARN MANUFACTURING

FIELD OF THE INVENTION

This invention relates generally to textile machinery and more particularly to an improved nozzle texturizer for use in manufacturing of yarn for carpets and the like.

BACKGROUND OF THE INVENTION

One of the steps employed in manufacturing of carpets using synthetic materials such as nylon or polypropylene is to subject extruded strands of the yarn material to a "texturizing" process wherein the strands are caused to become highly kinked throughout their length so as to impart resilience and body to yarns incorporating the strands. Texturizing is typically carried out by feeding an array of a large number such as 57 strands across a series of rollers and through a vertically disposed texturizer device at a high-speed such as 103 feet per second and at an elevated temperature such as 180° F. The texturizer is generally in the form of a rectangular block having a longitudinally extending central aperture varying in diameter at various locations to provide for a narrow input region, expanded nozzle region, and an enlarged exit region. Texturizing in such devices is initiated by momentarily blocking the outlet, deceasing the tension at which the strands are held, the resulting slack allowing the strands to undergo extensive kinking in the expanded nozzle region. This kinking effect is retained as a "memory" in the resulting yarn, into which the strands are incorporated after the yarn is wound onto and passed through a further series of reels or rollers for further processing.

A widely used prior art texturizer 10 is shown in FIG. 1 of the drawings. The texturizer is in the form of a rectangular block made up of two mating halves and having a longitudinally extending central aperture 12. The aperture has a relatively small diameter at a top input region 14, a larger diameter region 16 traversing its middle and located below compressed air inputs 18, a downwardly expanded conical nozzle region 20, and an enlarged exit region 22 at the bottom. Heated compressed air is introduced through apertures 24 in the block that communicate with inputs 18 to the central aperture through passageways 26. The inputs 18, a total of four being provided, are all located at the same axial position in relation to the central aperture, and the compressed air introduced therethrough provides a balanced force against the strands, without producing a significant swirling motion that would twist the strands around one another. In addition, swirling motion is prevented by introducing the air through passageways that are disposed at a small angle such as 10° to 12° with respect to the central bore. Yarns that are texturized by use of such a device require an additional process step known as "air entanglement" in order to obtain twisting as well as kinking in the product yarn. Provision of a texturizer that produces twisting, along with kinking, action would be highly advantageous.

Available texturizers as shown in FIG. 1 also have presented a problem in that the mating halves of the block have tended to become warped and separated from one another in use, allowing some of the strands to enter into the space between halves and become snagged or torn, thus reducing the quality of the yarn product. The snagged or torn strands upon moving downward also may cause the kinked material to become matted, plugging up the aperture and halting production. Prior texturizers of this type have generally been made of soft steel to permit easier fabrication, and the mating faces of the two halves have been forced together by air pressure and designed with a slight bow to compensate for warping, but the problem has persisted.

SUMMARY OF THE INVENTION

The present invention is directed to an improved nozzle texturizer wherein apertures for introduction of heated compressed air into a central longitudinal bore through which strands of extruded material are being fed are located at axially offset locations with respect to the central aperture, and the input apertures are disposed at defined angles much larger than angles used in prior devices. Introducing the compressed air in this manner imparts a swirling motion to the strands, causing them to be twisted around one another so that the array of strands is converted to a twisted as well as a kinked yarn. Thus, the need for a subsequent air entanglement step to obtain twisting is avoided. Separation of mating halves of the body of the device due to warping in use is avoided in the texturizer of this invention by making it of hardened steel that is resistant to warping. In addition, texturizers embodying the invention provide a better blending of colors for yarns made up of individual strands with varying colors.

It is, therefore, an object of this invention to provide a nozzle texturizer that imparts twisting as well as kinking action to multiple strands of extruded synthetic fiber material being processed therein.

Another object is to provide a nozzle texturizer that avoids the need for a subsequent air entanglement step in carpet yarn processing.

Yet another object is to provide a nozzle texturizer made up of mating halves that are resistant to warpage and separation from one another in use.

DESCRIPTION OF THE PREFERRED EMBODIMENT

Figure 1:
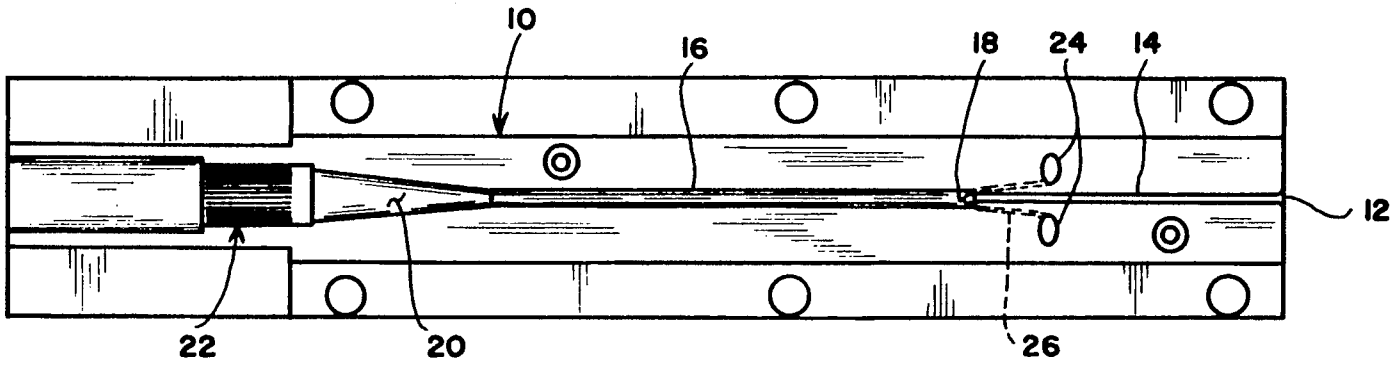
FIG. 1 (PRIOR ART)
FIG. 1 is an elevational view showing the inner face of a block forming one-half of a prior art texturizer.
Figure 2:
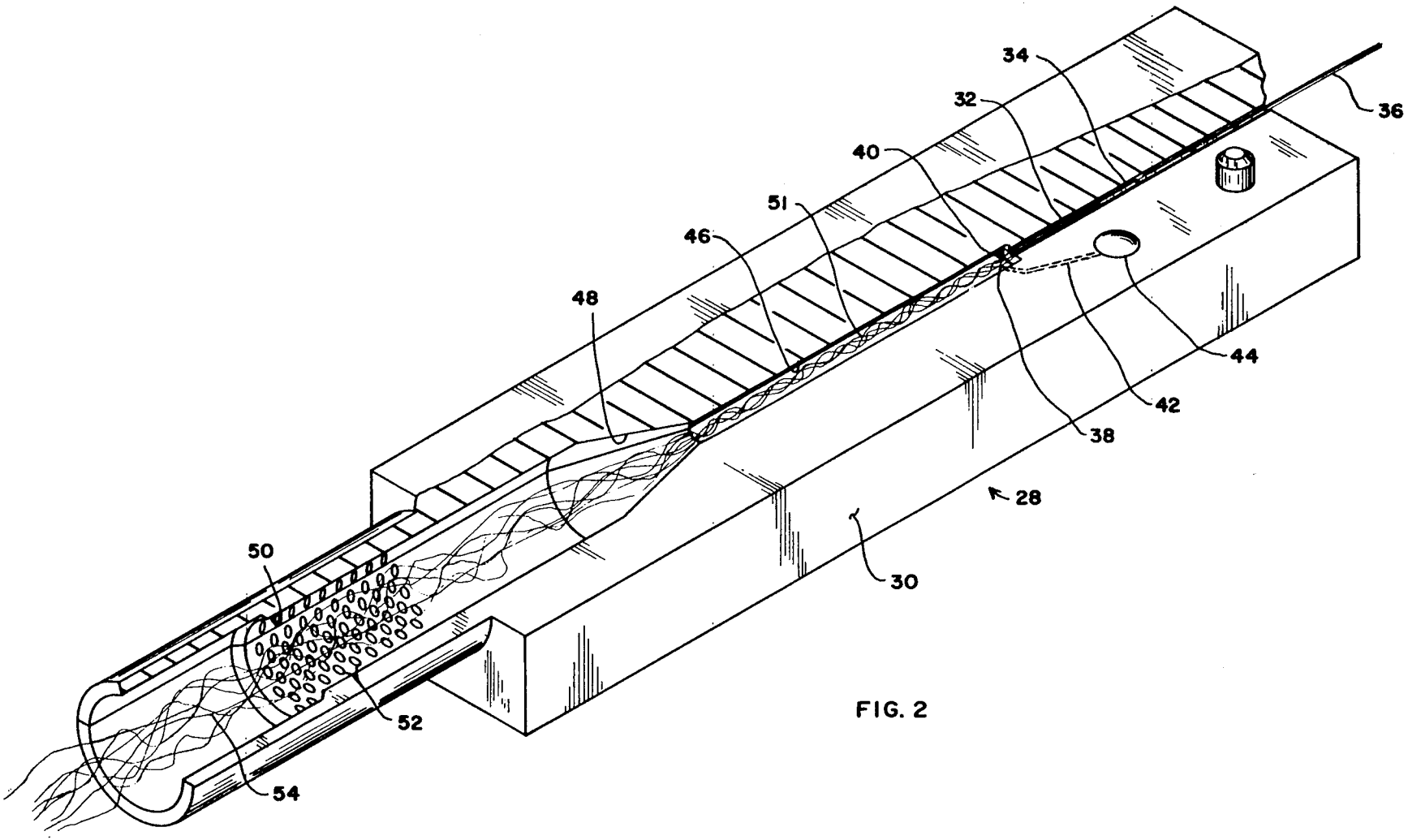
FIG. 2 is a perspective view, partially broken away, showing a texturizer embodying the invention.
Figure 3:
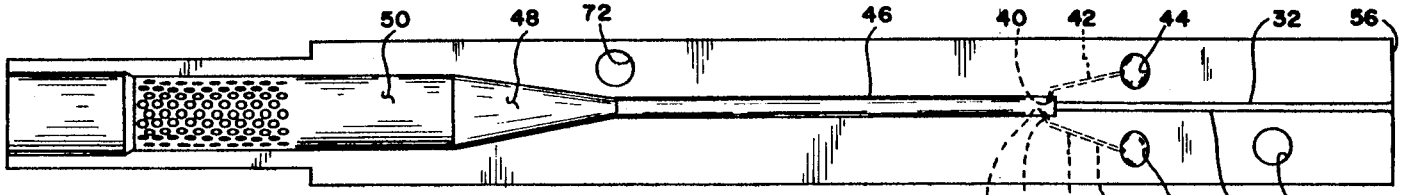
FIG. 3 is an elevational view showing a block forming one-half of the texturizer of this invention, with internal passageways shown in dotted lines.
Figure 4:
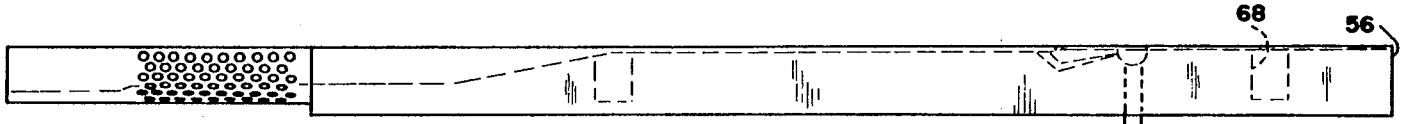
FIG. 4 is a side elevational view of the block of FIG. 3.

Referring to FIG. 2 of the drawings, there is shown a nozzle texturizer 28 made up of a generally rectangular block 30 having a central, longitudinally-extending aperture or bore 32 of varying diameters in different regions thereof and extending therethrough. At its upper region 34, the bore is narrower and sized to receive an array of strands 36 which may comprise 57 extruded filaments conveyed downward from extruders (not shown) by means of reels or rollers (not shown). Heated compressed air is introduced into the bore through apertures 38 and 40 which are in communication with an outside source of compressed air (not shown) through passageways 42 and air tube receiving holes 44. The middle portion 46 of the bore, immediately below apertures 38, has a slightly enlarged diameter to allow the compressed air stream to move freely downward.

A nozzle region 48 is disposed below the lower end of middle region 46, the nozzle preferably being flared out downwardly at an angle of 11°. The lower end of the nozzle communicates with an expanded exit region 50 provided with holes 52 to facilitate heat removal. In operation of the texturizer, the strands 36 are fed in at a high rate of speed such as 100 feet per second and at a temperature such as 180° F., which temperature may be maintained by heating of the introduced compressed air by means not shown or by providing heat strips as required inside of a housing (not shown) in which the texturizer is supported. By introducing the compressed air through offset apertures, a swirling motion is created, causing the strands to become twisted into the form of yarn 51. Upon entering the nozzle, the twisted yarn is subjected to kinking action, producing a yarn 54 that is twisted and highly kinked.

Figure 5:
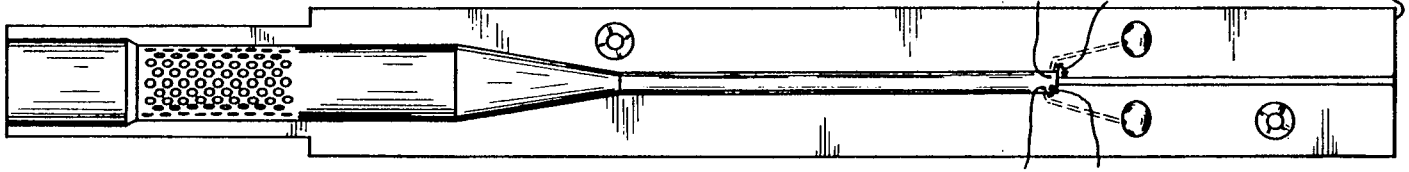
FIG. 5 is an elevational view of a block forming the second half of the texturizer when mated with the block of FIG. 3.
Figure 6:
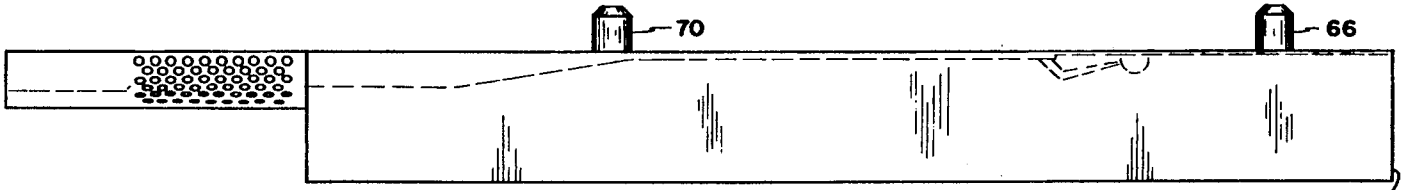
FIG. 6 is a side elevational view of the block of FIG. 5.

FIGS. 3-6 show the location and arrangement of air entry apertures whereby swirling action is imparted to the strands. A pair of air entry apertures 38 and 40 located in texturizer half 56 are longitudinally spaced apart a distance such as 0.30 inch to provide an offset air entry pattern, imparting a swirling motion in the longitudinal bore 32. The other half 57 of the texturizer, which is mateable with half 56 by placing inner faces of the halves together, also has a pair of apertures and internal passageways corresponding to those described for half 56, providing a total of four entry apertures. Passageways 42, which communicate air entry apertures 38 and 40 with apertures 44 that receive air from an external source, each have two segments, a first segment 58 that is disposed at a specified angle with respect to the center line of the bore, and a second segment 60 communicating the first segment with an air entry aperture. Angles defined by the first segment with respect to the bore are important in obtaining the desired swirling action. As shown in FIG. 5, angle 62 for the passageway segment entering aperture 40 may be 45°, while angle 64 for the segment entering aperture 38 may be slightly less, for example, 43°. These relatively large entry angles, as compared with prior art texturizers, as well as the slight difference in the two entry angles for passageway segments within the texturizer half, also contribute the desired swirling action. To enable connection of segments 58 to apertures 44, segments 60 may be located at an angle such as 12° with respect to the bore center line for the segment communicating with the segments disposed at 45° angles and 15° for the segments disposed at 43°, although the angles defined by segment 60 are not critical to the invention. For the embodiment shown, the upper portion 34 of the central bore 32 may have a diameter of 0.062 inch, the middle portion 46, a diameter of 0.125 inch, and the flared-out end of nozzle 48 along with exit region 50 may have a diameter of 0.500 inch. Entry apertures 40 and 38, along with passageways leading therethrough, may have a diameter of 0.062 inch.

Halves 56 and 57 may be assembled to form a generally rectangular block with an internal bore and passageways as described above by placing them with their inner faces in contact with one another, with alignment pins 66 and 70 projecting upward from half 57 engaging mating holes 68 and 72 in half 56. The two halves may be secured to one another by clamps (not shown) or by being forced together by air pressure provided in a chamber in which the texturizer is housed (not shown).

In order to prevent warpage under the conditions of heat and pressure encountered in operation, the half blocks are preferably made of steel hardened by means such as heat treatment to a hardness of Rockwell 38 to 42 R/C. This prevents the halves from becoming separated and causing tearing or entanglement of strands.

In addition to imparting a twisting as well as a kinking action to the strands being produced, texturizers embodying the invention provide another advantage in that for applications wherein individual strands being processed have different colors that contribute to a blending effect, an improvement to such effect is obtained.

While the invention described above in terms of the specific embodiment it is not to be understood as limited thereto but is limited only as indicated by the appended claims.

I claim:

1. A nozzle texturizer comprising an elongated metal body in the form of a generally rectangular block made up of a pair of halves, each half having a surface adapted for mating with a surface of the other half and having a straight bore extending longitudinally therethrough, said bore including an upper tubular region having a diameter adapted to receive a plurality of extruded strands of synthetic fiber material, a middle tubular region communicating with the bottom of said upper region and having a larger diameter than said upper region, and a frustro-conical, downwardly disposed nozzle region for imparting kinking action to said strands when passed therethrough by action of heated compressed air and a plurality of air entry apertures communicating said bore near the junction of said upper and middle regions with the exterior of said body;

each said half block including a pair of apertures offset longituidinally from one another a distance of 0.030 inch at their junctures with said bore; and one of said passageways in each of said halves being disposed at an angle of 45° with respect to the center line of said bore, and the other thereof being disposed at an angle of 43° with respect to said bore;

whereby, upon introduction of compressed air into the bore through said apertures, swirling action will be created, causing said strands to become twisted.

2. A nozzle texturizer as defined in claim 1 wherein said body is made of steel having a Rockwell hardness of 38 to 42 R/C.

3. In a nozzle texturizer having an elongated rectangular body made up of mating, longitudinally extending halves and having defined therein a bore extending longitudinally therethrough, the bore having an upper tubular region adapted to receive a plurality of strands of extruded synthetic fiber material, a middle tubular region adjacent said upper region and having a diameter larger than said upper region, a downwardly flared-out frusto-conical nozzle region below said middle region and a plurality of air entry apertures located on said bore near the juncture of said upper and middle regions, whereby upon passage of said strands through said bore by action of heated compressed air, said strands will become kinked in said nozzle region, the improvement comprising:

a pair of entry apertures defined in each of said halves, one member of each pair being longitudinally offset from the other member of the same pair; and said apertures at their juncture with said bore being coupled directly to air-conducting passageways, one of said passageways in each of said pairs being disposed at an angle of 45°, and the other thereof disposed at an angle of 43° projecting downward with respect to the center line of said bore.

4. The improvement as defined in claim 3 wherein an air entry aperture defined in one half of said body is longitudinally spaced apart a distance of 0.030 inch from another air entry aperture in said half.

* * * * *